US008336262B1

(12) United States Patent
Cox et al.

(10) Patent No.: US 8,336,262 B1
(45) Date of Patent: Dec. 25, 2012

(54) IMPACT LOAD DEFLECTOR SLEEVE AND REMOVABLE COLLAR ASSEMBLY FOR CABLE AND POST PROTECTION

(76) Inventors: Charles Russel Cox, Lakewood, CO (US); Nien-Yin Chang, Englewood, CO (US)

( * ) Notice: Subject to any disclaimer, the term of this patent is extended or adjusted under 35 U.S.C. 154(b) by 0 days.

(21) Appl. No.: 13/199,757

(22) Filed: Sep. 8, 2011

Related U.S. Application Data

(60) Division of application No. 12/583,903, filed on Aug. 27, 2009, now Pat. No. 8,132,790, which is a continuation-in-part of application No. 11/261,175, filed on Oct. 28, 2005, now abandoned, which is a continuation-in-part of application No. 10/976,201, filed on Oct. 28, 2004, now abandoned.

(51) Int. Cl.
*E04H 12/20* (2006.01)

(52) U.S. Cl. ..... 52/147; 256/1

(58) Field of Classification Search ..... 256/1, 11, 256/12, 12.5, 13.1; 52/147, 741.3; 174/136; 405/302.7
See application file for complete search history.

(56) References Cited

U.S. PATENT DOCUMENTS

| | | | | | |
|---|---|---|---|---|---|
| 1,709,556 | A | * | 4/1929 | Blackburn | 52/147 |
| 1,765,823 | A | * | 6/1930 | Burke | 52/147 |
| 1,902,945 | A | | 3/1933 | Blackburn | |
| 1,995,503 | A | * | 3/1935 | Nelson | 52/147 |
| 2,001,893 | A | | 5/1935 | Seelye | |
| 2,978,075 | A | * | 4/1961 | Newton | 52/147 |
| 3,005,436 | A | * | 10/1961 | Caldwell | 114/221 R |
| 3,926,141 | A | | 12/1975 | Taylor | |
| 4,407,600 | A | * | 10/1983 | Thompson | 403/23 |
| 4,638,611 | A | | 1/1987 | Vaughn | |
| 5,293,721 | A | | 3/1994 | Richard et al. | |
| 5,666,767 | A | | 9/1997 | Ohba | |
| 5,682,015 | A | | 10/1997 | Harben | |
| 5,918,404 | A | | 7/1999 | Ohba | |
| 2007/0080331 | A1 | | 4/2007 | Roth | |
| 2011/0057160 | A1 | | 3/2011 | Abu-Odeh et al. | |

* cited by examiner

*Primary Examiner* — Joshua Kennedy
(74) *Attorney, Agent, or Firm* — Emery L. Tracy

(57) ABSTRACT

A method for protecting cables and posts from damage by providing at least one first sleeve cut to a desired length, positioning each first sleeve over the cable, inserting a screw through an aperture on a last first sleeve positioned on the cable until the screw contacts the cable, providing a second sleeve having an inside diameter greater than an outside diameter of the first sleeve, positioning the second sleeve over the first sleeves, tensioning the cable, securing an end of the cable, sliding the second sleeve over the end, positioning a removable collar assembly between the first and second sleeves, maintaining the first and second sleeves from overlapping the removable collar and each other, maintaining the first and second sleeves from connection with each other, removing the holding screws from the last first sleeve, and rotating the sleeves and the removable collar assembly independently from each other.

8 Claims, 3 Drawing Sheets

10

IMPACT LOAD DEFLECTOR SLEEVE AND REMOVABLE COLLAR ASSEMBLY FOR CABLE AND POST PROTECTION

The present application is a divisional of patent application Ser. No. 12/583,903, filed on Aug. 27, 2009 now U.S. Pat. No. 8,132,790, entitled "Impact Load Deflector Sleeve and Removable Collar Assembly for Cable and Post Protection, which is a continuation-in-part of patent application Ser. No. 11/261,175, filed on Oct. 28, 2005, entitled "Impact Load Deflector Sleeve and Removable Collar Assembly for Cable and Post Protection, now abandoned, which is a continuation-in-part of patent application Ser. No. 10/976,201, filed on Oct. 28, 2004, entitled "CNC Impact Load Deflector Sleeve and Removable Collar for Cable and Post Protection", now abandoned.

BACKGROUND OF THE INVENTION

1. Field of the Invention

This invention relates generally to an apparatus for the protection of cables and posts (or columns) against the dynamic loads from rolling stones, vehicular impact, ice impact or other forms of transient loads and, more particularly, the invention relates to a CNC impact load deflector sleeve and removable collar installable on the cable holding the fence post, which, in turn, stretches rock fall drape net, which constitutes a rock fall mitigation fence system (RFMFS).

2. Description of the Prior Art

A rock fall mitigation fence (RFMF) is frequently used to protect the traveling vehicles against potential hazards of falling rocks. The fence system is composed of the fence cable, fence posts, and rock fall drape net resting on the cable, which, in turn, is stretched and supported on the fence posts and cable anchors. The fence posts are embedded in rock and the cable is connected to the ground anchor embedded in rock. The RFMFS functions as a flexible fence system for retaining falling rocks by dissipating their dynamic energy during the back and forth swing upon rock impact. The mass of falling rocks varies a great deal. It can range from a few hundred pounds to many tons.

When falling from the hill/mountain top or slope, a falling rock gains momentum as it rolls down the slope. When it comes in contact with a RFMFS, the rock rotates at an extremely high angular velocity, can sever fence-supporting cables, and knocks out or severely bends fence posts, cuts anything it touches. The failure of the RFMFS allows the falling rocks to land on the highway or, in some cases, on top of a moving vehicle, as demonstrated in the rock fall in Georgetown, Colo. on Apr. 8, 2004. To date the only mechanism for the failure prevention of the RFMFS is to use stronger nets, cables and posts. The literature search including the search on the US Patent and Trademark web site and the communication with fence installers did not reveal any other fence cable or post protection apparatuses as the CNC Impact Load Deflector Sleeve (CNC//ILDS) and Removable Collar (RC) submitted in this invention that deflect the moving rocks and impact force, and, thereby, reduce the chance of cable and post failures. Accordingly there exists a need for a mechanism for deflecting falling rocks and impact force, reducing the chance of fence failure and enhancing the safety of the traveling public.

SUMMARY

The present invention is a guard system for protecting cables or posts from damage by falling rocks and other dynamic forces. The guard assembly comprises a first sleeve rotatably positionable about one of the cables or the posts and a second sleeve rotatably positionable about the cable or the post. A removable collar assembly is positioned between the first sleeve and the second sleeve for maintaining the spacing between the first sleeve and the second sleeve with the removable collar assembly comprising a first removable collar and a second removable collar. The first removable collar has a first slot for receiving the cable or post and the second removable collar has a second slot for receiving the cable or post with the first slot extending from a perimeter of the first removable collar to a point past a center point of the first removable collar and the second slot extending from a perimeter of the second removable collar to a point past a center point of the second removable collar. The first sleeve is free from any overlap and connection with the removable collar assembly and the second sleeve is free from any overlap and connection with the removable collar assembly. The first sleeve, the second sleeve, and the removable collar assembly are independently rotatable from each other.

In addition, the present invention includes a method for protecting cables and posts from damage by falling rocks and other dynamic forces. The method comprises providing at least one first sleeve cut to a desired length, positioning each first sleeve over the cable, inserting a holding screw through an aperture on a last first sleeve positioned on the cable until the holding screw contacts the cable, providing a second sleeve having an inside diameter greater than an outside diameter of the first sleeve, positioning the second sleeve over the first sleeves, tensioning the cable, securing an end of the cable, sliding the second sleeve over the end, positioning a removable collar assembly between the first sleeve and the second sleeve, maintaining the first sleeve and the second sleeve from overlapping the removable collar and each other, maintaining the first sleeve and the second sleeve from connection with each other, removing the holding screws from the last first sleeve, and rotating the first sleeve, the second sleeve, and the removable collar assembly independently from each other.

DETAILED DESCRIPTION OF THE PREFERRED EMBODIMENTS

Figure 1:
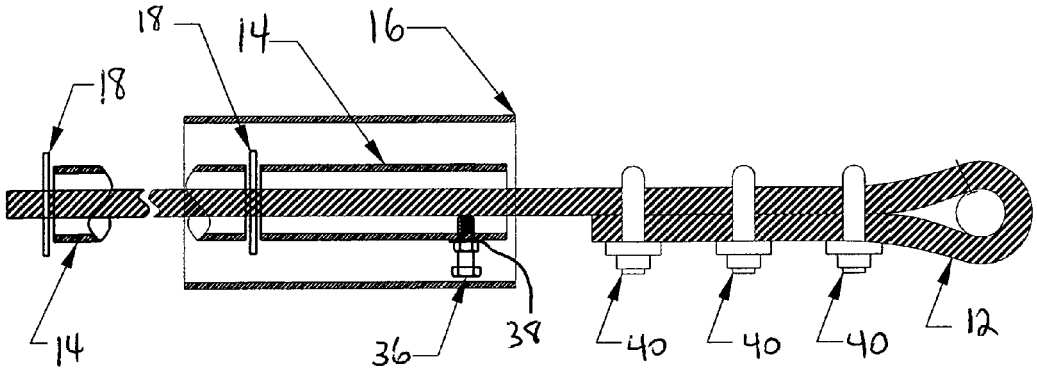
FIG. 1 is a sectional view illustrating an impact load deflector sleeve and removable collar assembly for cable and post protection, constructed in accordance with the present invention, prior to a large sleeve being positioned over the looped cable.
Figure 2:
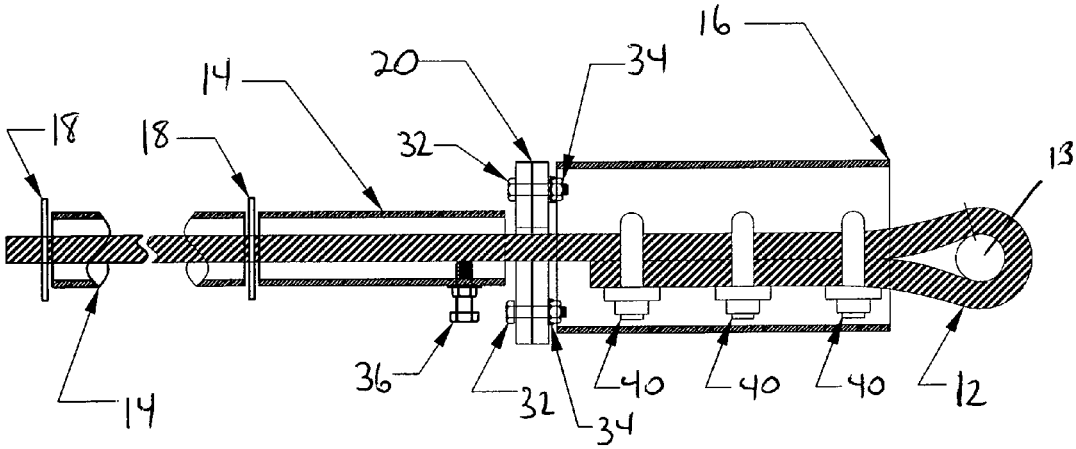
FIG. 2 is a sectional view illustrating an impact load deflector sleeve and removable collar assembly for cable and post protection, constructed in accordance with the present invention, subsequent to the large sleeve being positioned over the looped cable.
Figure 3:
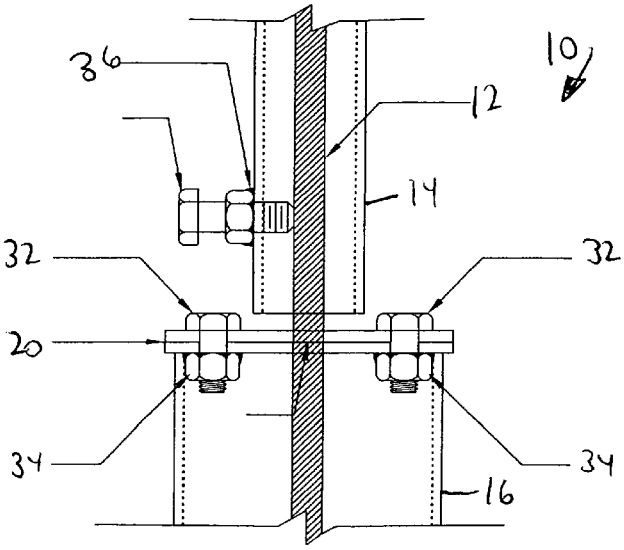
FIG. 3 is a sectional view illustrating a pair of constructed removable collars of the impact load deflector sleeve and removable collar assembly for cable and post protection, constructed in accordance with the present invention, with the removable collars bolted together.
Figure 4:
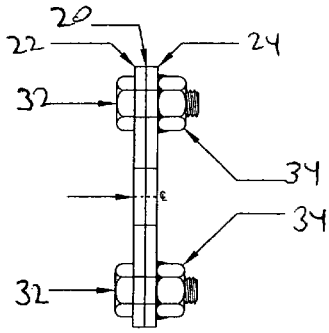
FIG. 4 is a side view illustrating the pair of constructed removable collars of the impact load deflector sleeve and removable collar assembly for cable and post protection, constructed in accordance with the present invention.
Figure 5:
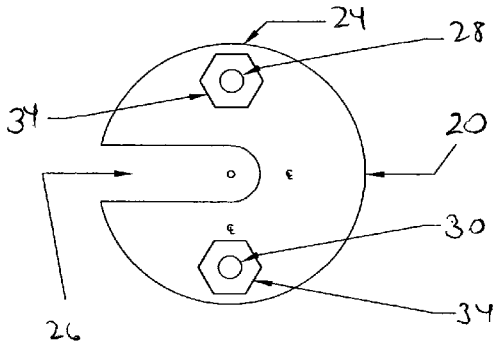
FIG. 5 is a top view illustrating a single removable collar of the impact load deflector sleeve and removable collar assembly for cable and post protection, constructed in accordance with the present invention.

As illustrated in FIGS. 1 and 2, the present invention is an impact load deflector sleeve and removable collar assembly, indicated generally at 10, for cable 12 and post 13 protection. It should be noted that the post 13 can be I-shaped, H-shaped, or an I-beam and is not limited by the description or drawings.

The impact load deflector assembly 10 of the present invention includes a plurality of small sleeves 14, a large sleeve 16, a plurality of washers 18 between each adjacent small sleeve 14, and a removable collar assembly 20 positioned between one of the small sleeves 14 and the large sleeve 16. The collar assembly 20 can also be positioned between adjacent large sleeves 16. Furthermore, as will be described in further detail below, there can be a plurality of small sleeves 14 and/or a plurality of large sleeves 16 and the number of sleeves 14, 16 is not limited by the drawings and description herein.

The impact load deflector assembly 10 of the present invention allows the small sleeves 14 and the large sleeve 16 to deflect a rolling rock or other dynamic force upon contact and, thereby, reduces the failure potential of the fence cable 12. It should be noted that the washers 18 can be any desired diameter including having a diameter larger than the diameter of the small sleeves 14, having a diameter smaller than the diameter of the large sleeves 16, and having a diameter larger than the diameter of the large sleeves 16.

The small sleeves 14 and the large sleeve 16 are preferably a cylindrical tube of any appropriate material made to loosely embrace a cable or a post to allow its near frictionless rotation about the cable or post. The length of the small sleeves 14 and the large sleeve 16 are determined by the field conditions present at the cable installation site and the desires of the construction team.

FIGS. 3-7 illustrate the removable collar assembly 20 of the impact load deflector assembly 10 of the present invention. The removable collar assembly 20 can be easily installed and removed from the cable 12 for easy construction and repair. The removable collar assembly 20 is positioned between two different-size sleeves to prevent the smaller sleeve 14 from sliding or slipping into the large sleeve 16.

The removable collar assembly preferably includes a first removable collar 22 and a second removable collar 24. Each removable collar 22, 24 has a substantially circular cross-sectional configuration with a slot 26 formed therein extending from a perimeter of the removable collar 22, 24 to a point past a center point. In addition, each removable collar 22, 24 has a first aperture 28 and a second aperture 30 for receiving a bolt 32 or other releasable fastening mechanism.

Figure 6:
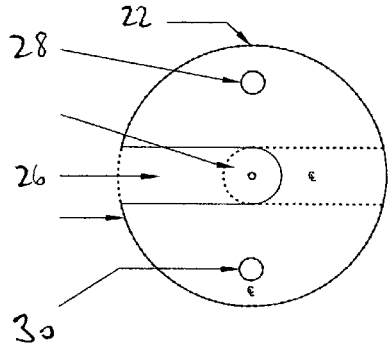
FIG. 6 is a top view illustrating the pair of constructed removable collars of the impact load deflector sleeve and removable collar assembly for cable and post protection, constructed in accordance with the present invention.
Figure 7:
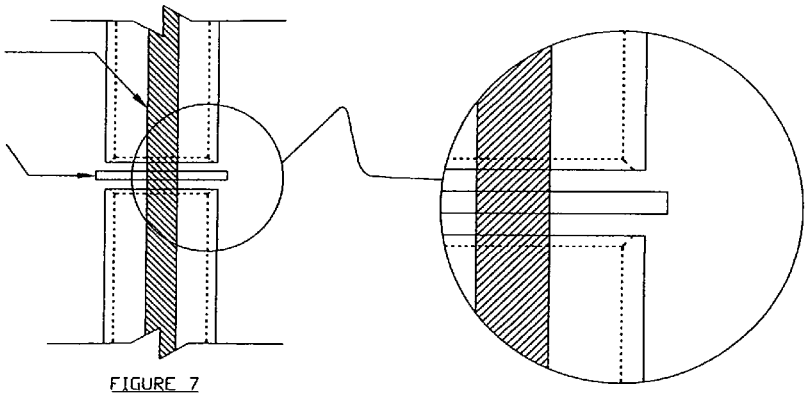
FIG. 7 is a sectional view illustrating the impact load deflector sleeve and removable collar assembly for cable and post protection, constructed in accordance with the present invention, with the small sleeve having a beveled inner edge.
Figure 9:
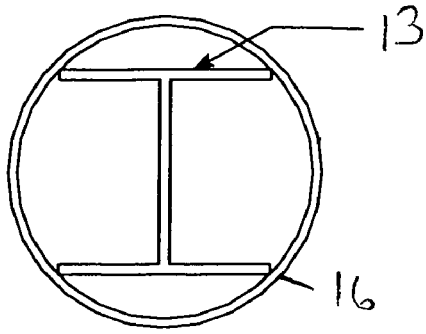
FIG. 9 is a top plan view illustrating the impact load deflector sleeve and removable collar assembly for cable and post protection, constructed in accordance with the present invention, with the sleeve positioned over a post.
Figure 8:
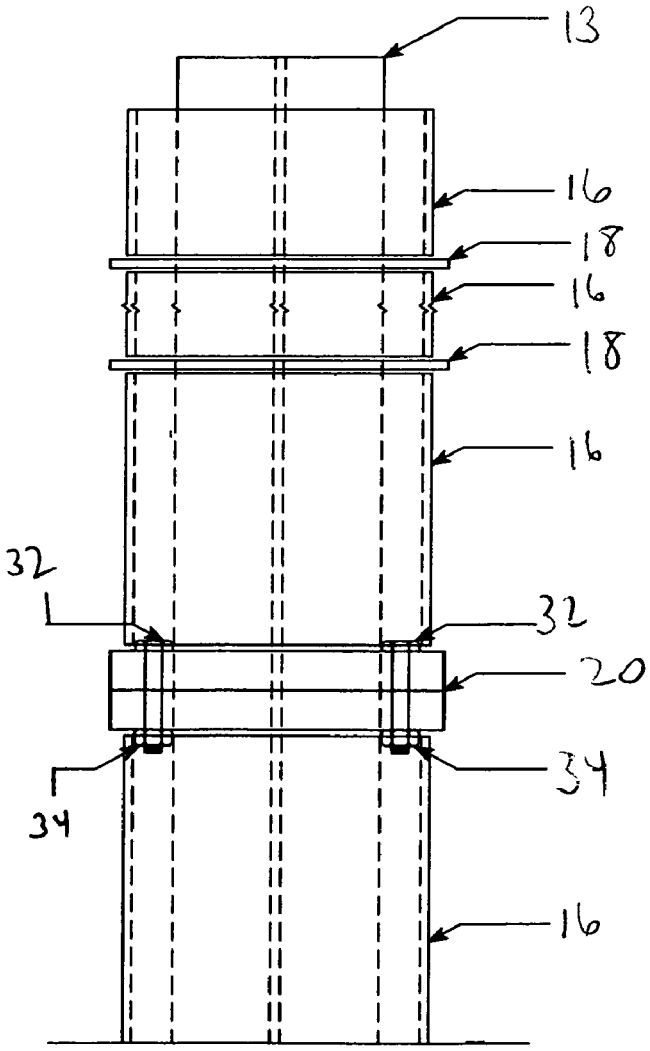
FIG. 8 is a sectional view illustrating the impact load deflector sleeve and removable collar assembly for cable and post protection, constructed in accordance with the present invention, with the sleeve positioned over a post.

To assemble or construct the removable collar assembly 20 for use with the impact load deflector assembly 10 of the present invention, first, the cable 12 or post is inserted into the slot 26 on the first removable collar 22. As illustrated in FIG. 6, the second removable collar 24 is positioned about the cable 12 or post such that the slots 26 of each removable collar 22, 24 are opposite each other. A first bolt 32 is inserted into the first aperture 28 of the first removable collar 22 and the second aperture 30 of the second removable collar 24 and a second bolt 32 is inserted into the second aperture 30 of the first removable collar 22 and the first aperture 28 of the second removable collar 24. A nut 34 or other tightening mechanism is releasably secured to each of the bolts 32 to maintain the first removable collar 22 to the second removable collar 24. Further construction of the impact load deflector assembly 10 will be discussed below.

The load impact deflector assembly 10 of the present invention reduces the impact load effect on both cables 12 and fence posts by deflecting the falling rocks upon contact. FIGS. 1 and 2 illustrate the load impact deflector assembly 10 installed about the cable 12. The small sleeves 14 and large sleeve 16 are preferably cylindrical and constructed from an appropriate material (e.g., steel) and have an appropriate diameter, length, and thickness for embracing a cable 12 or post with a clearance for near frictionless rotation. The thickness and material type of the sleeves 14, 16 are preferably selected to provide sufficient strength to prevent the puncture by the rolling rocks. The washers 18 can be positioned between adjacent small sleeves 14 to maintain the spacing of the small sleeves 14 and inhibit contact between adjacent small sleeves 14.

Upon contacting any high-speed rolling rock, the load impact deflector assembly 10 rotates nearly frictionless about the cable 12 and, thereby, avoids cable cut. It should be noted that the sleeves 14, 16 and removable collars 22, 24 can be constructed from any material deemed corrosion resistant, and sufficiently strong against the destructive force of rolling stones, wind, vehicular impact, or any other forms of impact force. In addition to the above, the small sleeves 14 of the load impact deflector assembly 10 have a beveled inner edge. Preferably, the bevel is at a forty-five (45°) degree angle and is beveled to one-half the thickness of the wall of the small sleeve 14. The purpose of the bevel is that if the small sleeves 14 are hit in such a manner that they deflect at a sharp angle, the edge of the sleeve 14 will not cut into the cable 12.

To mitigate the failure potential of a rock fall mitigation fence system, the sleeves 14, 16 of the load impact deflector assembly 10 can be installed along the entire length of the cable 12 and/or the post. The functionality of the load impact deflector assembly 10 is explained as follows:

- The load impact deflector assembly 10 rotates nearly freely around the cable 12 and post that they are protecting.
- Upon contacting a sleeve 14, 16, the impact force from a rolling rock or any other impact sources, causes the sleeves 14, 16 to rotate.
- The action of sleeve rotation deflects the impact force and rock.
- The deflection of the impact force reduces the damage potential of the cable 12 and post.

The removable collar assembly 20 is preferably installed between a small sleeve 14 at the lowest point of the cable 12 and a large sleeve 16 for protecting the connection just above the ground anchor and the small sleeve 14 for protecting the cable 12 right above the cable connection.

The construction of the load impact deflector assembly 10 of the present invention will now be discussed. As understood by those persons skilled in the art, the following description is just one manner of constructing the load impact deflector assembly 10.

Before the load impact deflector assembly 10 installation, the fence, fence post, cable anchors, and fence supporting cable are installed by a qualified fence installer. At this time the cable where the sleeves are to be installed is loose. The procedure for the load impact deflector assembly 10 sleeve installation is specified as follows:

1. First, the small sleeves 14 cut to a desired length according to field conditions are positioned over the cable 12 or post with a washer 18 between each adjacent small sleeve 14. Slide a washer 18 onto the cable 12.
2. Slide a small sleeve 14 onto the cable 12.
3. Slide on another washer 18 followed by another small sleeve 14.
4. Repeat the above until the desired portion of the cable 14 is covered with small sleeves 14. The number of small sleeves 14 and washers 18 are dependent on the length of the cable 12 or post.
5. The last small sleeve 14 installed on the cable 12 is the sleeve 14 with the temporary assembly holding bolt 36 (this small sleeve 14 is cut to length to fit the length of cable 12 as needed) and the bolt 36 is tightened to the cable 12. Note: the bolt 36 is removed at the end of the installation procedure and discarded. It is imperative that the bolt be removed as to facilitate the last small sleeve 14 to rotate as required when impacted with a load.
6. Wrap the cable 12 around a cable anchor 13.
7. After the last small sleeve 14 is temporarily fixed in place with the temporary assembly holding bolt 36, a sufficient number of large sleeves 16 are installed around the small sleeves 12. The large sleeves 16 can be hooked behind the temporary assembly holding bolt 36 hold them in place while the cable 12 is tensioned and clamped.
8. Tension the cable 12 to the manufactures recommended tension and clamp the cable 12 with cable clamps 14 to hold the cable in tension. Note: The tension is used to support the fence posts and fence.
9. Slide the large sleeves 16 down to cover the wrapped around and clamped part of the cable 12.
10. Install the first removable collar 22 between the last small sleeve 14 and the first large sleeve 16. Position the removable collar 22 such that the first removable collar 22 with the welded nuts 34 is positioned inside the large sleeve 16 and the cable 12 centered in the slot 26. Then, the second removable collar 24 is fitted onto the bottom part of the first removable collar 22 with the cable 12 centered and the slot 26 opening in the opposite direction with respect to the first removable collar 22. The bolts 32 are inserted through the two pairs of matching holes 28, 30 on the removable collars 22, 24 and bolts 32 tightened. Now the cable 12 is centered in the hole formed by the two removable collars 22, 24.
11. The temporary assembly holding bolt 36 is now removed and discarded.
12. The installation procedure is now complete.

When any sleeve 14, 16 is damaged or the fence repairs require the removal of the sleeves 14, 16, the following procedures are to be followed:

1. Obtain the proper size bolt 36 for the temporary assembly holding bolt 36, install it in the last small sleeve 14, and tighten it to the cable 12.
2. Remove the removable collars 22, 24.
3. Slide the large sleeves 16 over the small sleeves 16 and rest them on the temporary assembly holding bolt 36. The cable clamps 40 are now exposed.
4. Loosen the cable clamps 40 and remove the cable 12 from the cable anchor 13. Now, the cable is untensioned.
5. Remove the large sleeves 16.
6. Loosen the temporary assembly holding bolt 36 and remove the small sleeves 14 and washers 18.
7. Remove all damaged sleeves 14, 16 and repair the fence, if necessary.
8. Replace all damaged sleeves 14, 16 with new ones and follow the installation procedures reinstall all the sleeves 14, 16 and associated part, tension the cable 12 to manufactures specifications.

The removable collar assembly 20 of the impact load deflector assembly 10 inhibits the small sleeve 14 from slipping into the large sleeve 16. The fence system has to be structurally designed. Many instances of fence failures showed that the falling rocks severed the cables 12, and uprooted or severely bent the fence post. The failure of a rock fall mitigation fence system imposes a safety risk of traveling motorists from falling rocks as demonstrated in the recent rock fall event along Interstate Highway I 70 near Georgetown, Colo. on Apr. 8, 2004. To reduce the risk of failure of a rock fall mitigation fence system, the fence cable needs to be protected from the cut by the large falling rock and the sleeve in the present invention provides such protection. In an event of need for sleeve replacement, the removable collar assembly 20 enhances the constructability because it can be easily opened and removed, the large sleeve 16 slips over the small sleeve 14 and cable 12 unbolted to allow sleeve 14, 16 removal and repair.

Besides, the impact force from falling rocks, the sleeves 14, 16 and removable collar assembly 20 of the impact load deflector assembly 10 of the present invention also provide a means of deflecting impact (or dynamic) forces, like those from vehicular impact, and ice impact, etc.

In sum, the sleeves 14, 16 and removable collar assembly 20 of the impact load deflector assembly 10 of the present invention are designed to provide a means of protecting fence cables 12 and posts 13. Without such protection, a conventional rock fall protection fence frequently fails upon impact from large falling rocks spinning at a high angular velocity and with an immense momentum, as demonstrated in many rock fall-induced fence failures. The sleeves 14, 16 embrace a cable 12 or post 13 to deflect falling rocks spinning at a high angular velocity and associated impact forces and, thereby, protect them by avoiding detrimental blows from the falling rocks. The removable collar assembly 20 is used when two different-size sleeves are used avoiding a smaller sleeve 14 from slipping into a larger sleeve 16 and to assure the protection the sleeves 14, 16 are designed. The washers 18 between the small sleeves 14 allow the small sleeves 14 to spin better when hit. Additionally, the removable collar assembly 20 enhances the constructability and eases the maintenance of a rock fall mitigation fence system. The sleeves 14, 16 together with the removable collar assembly 20 embraces the fence cable and post, provides a means of their protection, and enhances the safety of traveling motorists.

It should be noted that the removable collar assembly 20 is designed and shaped such that none of the sleeves 14, 16 overlap with the removable collar assembly 20. It should also be noted that the sleeves 14, 16 are free from connection with the removable collar assembly 20 such that the sleeves 14, 16 and the removable collar assembly 20 are independently rotatable from each other.

In sum, when falling from the hill/mountain top or slope, a falling rock gains momentum as it rolls down the slope. The rock is rotating at a very high angular velocity and cuts the cable 12 like a saw blade. When it comes in contact with a RFMFS, the rock rotates at an extremely high angular velocity, can sever fence-supporting cables, and knocks out or severely bends fence posts, cuts anything it touches. The cable protection sleeve 14, 16 rotates when struck by a rock moving at high velocity and with or without angular momentum. Because the rock statistically does not hit the cable 12 or the sleeves 14, 16 exactly at the center of gravity, the sleeve 14, 16 rotates giving the cable 12 the time to move and allow the rock to go around the cable and not cutting the highly tensioned cable 12. Without the sleeve 14, 16, the cable 12 is cut and the fence fails allow the rock to continue on towards roads, buildings or other features that the fence is designed to protect. Tests conducted by CDOT on the ILD sleeves verified that rotating rocks are deflected by cables protected by the ILD sleeves and are cut by the same rocks under the same conditions without the ILD sleeves.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A method for protecting cables and posts from damage by falling rocks and other dynamic forces, the guard assembly comprising:

providing at least one first sleeve cut to a desired length;

positioning each at least one first sleeve over a cable;

inserting a holding screw through an aperture on a last first sleeve positioned on the cable until the holding screw contacts the cable;

providing a second sleeve having an inside diameter greater than an outside diameter of the last first sleeve;

positioning the second sleeve over the last first sleeve;

tensioning the cable;

securing an end of the cable;

sliding the second sleeve over the end;

positioning a removable collar assembly between the last first sleeve and the second sleeve;

maintaining the last first sleeve and the second sleeve from overlapping the removable collar and each other;

maintaining the last first sleeve and the second sleeve from connection with each other;

removing the holding screw from the last first sleeve; and rotating the last first sleeve, the second sleeve, and the removable collar assembly independently from each other.

2. The method of claim 1 and further comprising:

beveling an inside edge of the at least one first sleeve on both ends of the sleeve.

3. The method of claim 1 and further comprising:

providing a plurality of first sleeves; and positioning a washer between each adjacent first sleeve.

4. The method of claim 1 wherein the removable collar assembly includes a first removable collar and a second removable collar releasably secured to the first removable collar.

5. The method of claim 4 and further comprising:

forming a slot in each removable collar for receiving the cable or post.

6. The method of claim 5 and further comprising:

forming a first aperture and a second aperture in each removable collar.

7. The method of claim 6 and further comprising:

positioning the first removable collar against the second removable collar such that the slot of the first removable collar is substantially opposite the slot of the second removable collar, the first aperture of the first removable collar is substantially aligned with the second slot of the second removable collar, and the second aperture of the first removable collar is substantially aligned with the first aperture of the second removable collar.

8. The method of claim 7 and further comprising:

inserting fastening means through the first and second apertures of the first and second removable collars for releasably securing the first removable collar to the second removable collar.

* * * * *